US011326337B2

(12) United States Patent
Ohde

(10) Patent No.: US 11,326,337 B2
(45) Date of Patent: May 10, 2022

(54) BUILDING STRUCTURE, BUILDING, AND BUILDING METHOD

(71) Applicant: Kabushiki Kaisha SBL, Oyama (JP)

(72) Inventor: Masataka Ohde, Oyama (JP)

( * ) Notice: Subject to any disclaimer, the term of this patent is extended or adjusted under 35 U.S.C. 154(b) by 0 days.

(21) Appl. No.: 16/618,363

(22) PCT Filed: Nov. 13, 2017

(86) PCT No.: PCT/JP2017/040746
§ 371 (c)(1),
(2) Date: Dec. 1, 2019

(87) PCT Pub. No.: WO2019/092882
PCT Pub. Date: May 16, 2019

(65) Prior Publication Data

US 2021/0285205 A1 Sep. 16, 2021

(51) Int. Cl.
*E04B 1/19* (2006.01)

(52) U.S. Cl.
CPC ..... *E04B 1/19* (2013.01); *E04B 2001/199* (2013.01); *E04B 2001/1963* (2013.01); *E04B 2001/1984* (2013.01)

(58) Field of Classification Search
CPC ..... E04B 1/3527; E04B 2001/199; E04B 2001/1963; E04B 2001/1984; E04B 1/19
See application file for complete search history.

(56) References Cited

U.S. PATENT DOCUMENTS

| | | | | | |
|---|---|---|---|---|---|
| 2,979,169 | A * | 4/1961 | Yolles | E04B 1/19 | 52/654.1 |
| 3,477,189 | A * | 11/1969 | Merson | E04B 1/19 | 52/650.3 |
| 5,483,780 | A * | 1/1996 | Stumpf | E04B 1/1903 | 52/650.3 |
| 6,543,198 | B1 * | 4/2003 | Kubik | E04B 1/19 | 52/638 |

FOREIGN PATENT DOCUMENTS

| | | | | |
|---|---|---|---|---|
| FR | 1361991 | A * | 5/1964 | E04B 1/19 |
| FR | 2515160 | A1 * | 4/1983 | E04B 1/3527 |
| GB | 2028905 | A * | 3/1980 | E04B 1/3527 |
| WO | WO-9322515 | A1 * | 11/1993 | E04B 1/19 |
| WO | WO-9625565 | A1 * | 8/1996 | E04B 1/19 |

* cited by examiner

*Primary Examiner* — Christine T Cajilig
(74) *Attorney, Agent, or Firm* — Patshegen IP LLC; Moshe Pinchas

(57) ABSTRACT

A building structure that can be assembled easily with high assembling precision is provided.
The building structure of the present invention is a building structure for transmitting a load on a roof to a post, and includes a unit (10) joined to a post (20). The unit includes three or more first beams arranged in parallel in one direction and three or more second beams arranged in parallel in another direction intersecting the one direction. Each first beam and each second beam has a truss structure. In a section where the first beam intersects the second beam, an upper chord of the first beam is disposed on an upper chord of the second beam and is joined to the upper chord of the (Continued)

second beam via a joining member, using a fastener. In the section where the first beam intersects the second beam, a lower chord of the first beam is disposed on a lower chord of the second beam and is joined to the lower chord of the second beam via a joining member, using a fastener.

6 Claims, 10 Drawing Sheets

BUILDING STRUCTURE, BUILDING, AND BUILDING METHOD

TECHNICAL FIELD

The present invention relates to a building structure for transmitting a load on a roof to a post, a building having the building structure, and a building method for the building.

BACKGROUND ART

Conveniently, a lattice beam having a number of first beams arranged in parallel in one direction and a number of second beams arranged in parallel in another direction intersecting the one direction is known (see, e.g., Patent Literature 1 cited below). This conventional lattice beam, however, is structured such that the first and second beams are made of heavy shaped steels or steel pipes and that one or both of each first beam and each second beam is constructed by welding short steel materials together. This poses a problem that assembling the lattice structure is not easy and takes much time and an additional problem that assembling precision is low.

Meanwhile, a building structure having a plurality of units is known also as a building structure for transmitting a load on a roof to a post (see, e.g., Patent Literature 2 cited below). Individual units are assembled in a low place and then are carried to a high place in order, using a crane. However, a unit suspended with wires is unstable. This raises a problem that the suspended unit tends to collide with a unit or the like already joined to a post.

CITATION LIST

Patent Literature

Patent Literature 1: JP S58-50181 A
Patent Literature 2: Japanese Patent No. 4857272

SUMMARY OF INVENTION

Technical Problems

A first object of the present invention for solving a first problem is to provide a building structure that can be assembled easily in a short time with high assembling precision and a building having the building structure. A second object of the present invention for solving a second problem is to provide a building method by which a suspended unit's colliding with a unit or the like already set in place can be prevented.

Solution to Problems

In order to solve the above problems, the present invention provides a building structure for transmitting a load on a roof to a post. The building structure is characterized in that the building structure includes a unit joined to a post, the unit including three or more first beams arranged in parallel in one direction and three or more second beams arranged in parallel in another direction intersecting the one direction, that each first beam and each second beam has a truss structure, and that in a section where the first beam intersects the second beam, an upper chord of the first beam is disposed on an upper chord of the second beam and is joined to the upper chord of the second beam via a joining member, using a fastener, and a lower chord of the first beam is disposed on a lower chord of the second beam and is joined to the lower chord of the second beam via a joining member, using a fastener.

The present invention provides also a building having the above building structure.

The present invention further provides a building method for a building having a building structure for transmitting a load on a roof to a post. The building method includes: a process of forming a unit on a foundation on which posts are already set in place, the unit being structured such that the unit includes three or more first beams arranged in parallel in one direction and three or more second beams arranged in parallel in another direction intersecting the one direction, that each first beam and each second beam has a truss structure, and that in a section where the first beam intersects the second beam, an upper chord of the first beam is disposed on an upper chord of the second beam and is joined to the upper chord of the second beam via a joining member, using a fastener, and a lower chord of the first beam is disposed on a lower chord of the second beam and is joined to the lower chord of the second beam via a joining member, using a fastener; and a process of lifting up the unit while using the posts as a guide.

Advantageous Effects of Invention

In the building structure and the building according to the present invention, in the section where the first beam intersects the second beam, the upper chord of the first beam is disposed on the upper chord of the second beam and is joined to the upper chord of the second beam via the joining member, using the fastener. It is therefore unnecessary to construct a structure in which the upper chord of the first beam and the upper chord of the second beam are joined together along an axial direction. Likewise, in the section where the first beam intersects the second beam, the lower chord of the first beam is disposed on the lower chord of the second beam and is joined to the lower chord of the second beam via the joining member, using the fastener. It is therefore unnecessary to construct a structure in which the lower chord of the first beam and the lower chord of the second beam are joined together along the axial direction. According to the present invention, each chord can be provided as a single member. This makes assembling work easy and allows assembling work to be finished in a short time. The first beam and the second beam are joined by using the fastener. This improves assembling precision significantly, compared to a case of welding the first beam and the second beam together. According to the building method of the present invention, the unit is formed on the foundation on which posts are already set in place. It is therefore unnecessary to secure a unit assembling place around the foundation. This offers an advantage that the building can be constructed even in a building site with a small area. Because the unit is lifted up as the posts are used as a guide, the ascending unit is kept stable. According to the present invention, therefore, the ascending unit's colliding with a unit or the like already set in place can be prevented.

DESCRIPTION OF EMBODIMENTS

Embodiments of the present invention will hereinafter be described specifically with reference to drawings. The technical scope of the present invention is not limited to the contents of the following description.

Embodiments

A building structure of the present invention is a building structure for transmitting a load on a roof to a post, and includes a single unit or a plurality of units. A building structure according to an embodiment of the present invention includes a plurality of units 10, as shown in FIG. 1.

Figure 1:
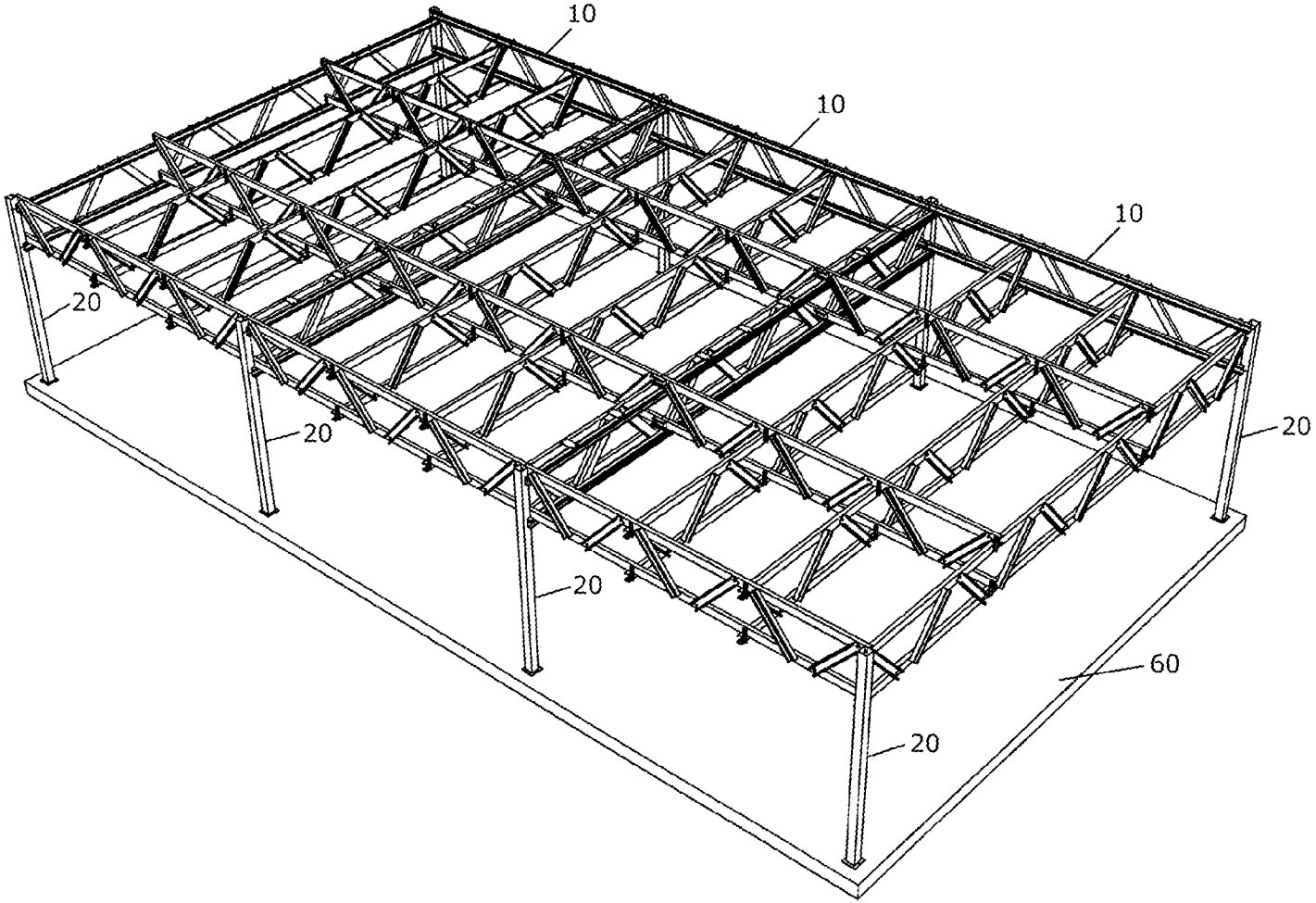
FIG. 1 is a perspective view of a building structure according to an embodiment of the present invention.
Figure 2:
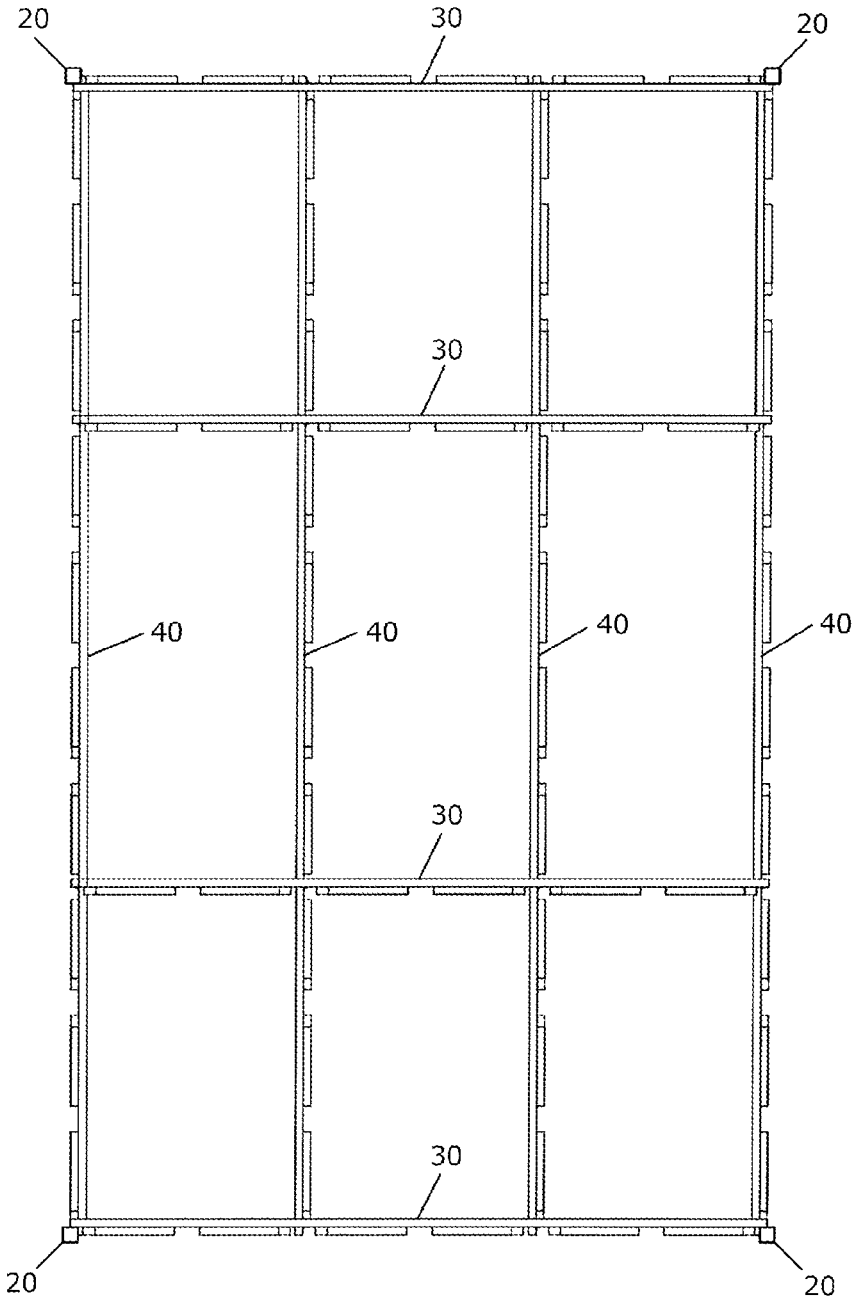
FIG. 2 is a plan view of a unit.
Figure 3:
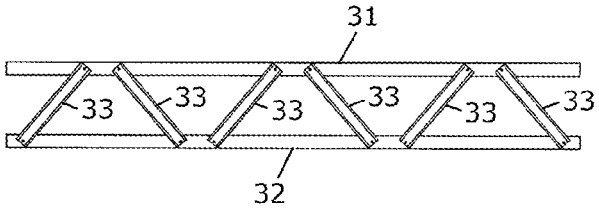
FIG. 3 is a side view of a first beam.

As shown in FIGS. 1 and 2, each unit 10 is joined to posts 20. As shown in FIG. 2, each unit 10 has three or more first beams 30 arranged in parallel in one direction (horizontal direction in FIG. 2). As shown in FIG. 3, each first beam 30 has a truss structure. More specifically, the first beam 30 has an upper chord 31, a lower chord 32, and diagonal bracings 33. The upper chord 31 and the lower chord 32 are set parallel with each other, and the diagonal bracings 33 are arranged between upper chord 31 and the lower chord 32. It is preferable that the upper chord 31, the lower chord 32, and the diagonal bracings 33 be made of light shaped steels having the same sectional dimension (e.g., lip channel steels, light-gauge channel steels, or the like). Light shaped steels are easier to join them than heavy shaped steels and steel pipes are, thus allowing a reduction in a time required for assembling. In addition, light shaped steels can be mechanically joined by using fasteners (e.g., bolts, self-drill screws, rivets, or the like) without welding. This eliminates a drop in assembling precision resulting from welding distortion, thus achieving high assembling precision. Using light shaped steels also offers an advantage of reducing the weight of a building and cutting a material cost. Different from heavy shaped steels, light shaped steels allow roof materials or wall materials to be attached directly thereto, thus allowing a reduction in a construction cost. Further, the upper chord 31, the lower chord 32, and the diagonal bracing 33 that have the same sectional dimension allow a reduction in costs related to design and manufacturing.

As shown in FIG. 3, the upper chord 31 is provided as a single member. So is the lower chord 32. According to this configuration, because the axis of each of the upper and lower chords 31 and 32 is a straight line, assembling precision can be improved. It is preferable that a number of the diagonal bracings 33 arranged between the upper chord 31 and the lower chord 32 have the same length. This is so because using diagonal bracings with different lengths constitutes a factor that reduces the efficiency of assembling work. It is preferable that, to enable use of diagonal bracings with the same length, the upper chord 31 and the lower chord 32 be set parallel with each other as respective tilt angles of the diagonal bracings 33 be made equal. A configuration in which the upper chord 31 and the lower chord 32 are set parallel with each other makes it easy for the first beam 30 to intersect a second beam.

Figure 4:
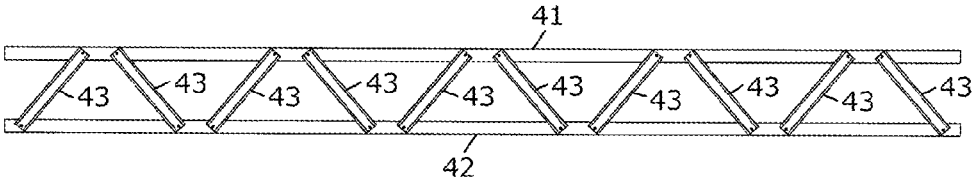
FIG. 4 is a side view of a second beam.

As shown in FIG. 2, each unit 10 further has three or more second beams 40 arranged in parallel in another direction (longitudinal direction in FIG. 2) intersecting the one direction. As shown in FIG. 4, each second beam 40 has a truss structure, as each first beam 30 does. More specifically, the second beam 40 has an upper chord 41, a lower chord 42, and diagonal bracings 43. The upper chord 41 and the lower chord 42 are set parallel with each other, and the diagonal bracings 43 are arranged between upper chord 41 and the lower chord 42. It is preferable that the upper chord 41, the lower chord 42, and the diagonal bracings 43 be made of light shaped steels having the same sectional dimension. As shown in FIG. 4, the upper chord 41 of the second beam 40 is provided as a single member, as the upper chord 31 of the first beam 30 is. So is the lower chord 42. It is preferable that a number of the diagonal bracings 43 arranged between the upper chord 41 and the lower chord 42 have the same length.

Figure 5:
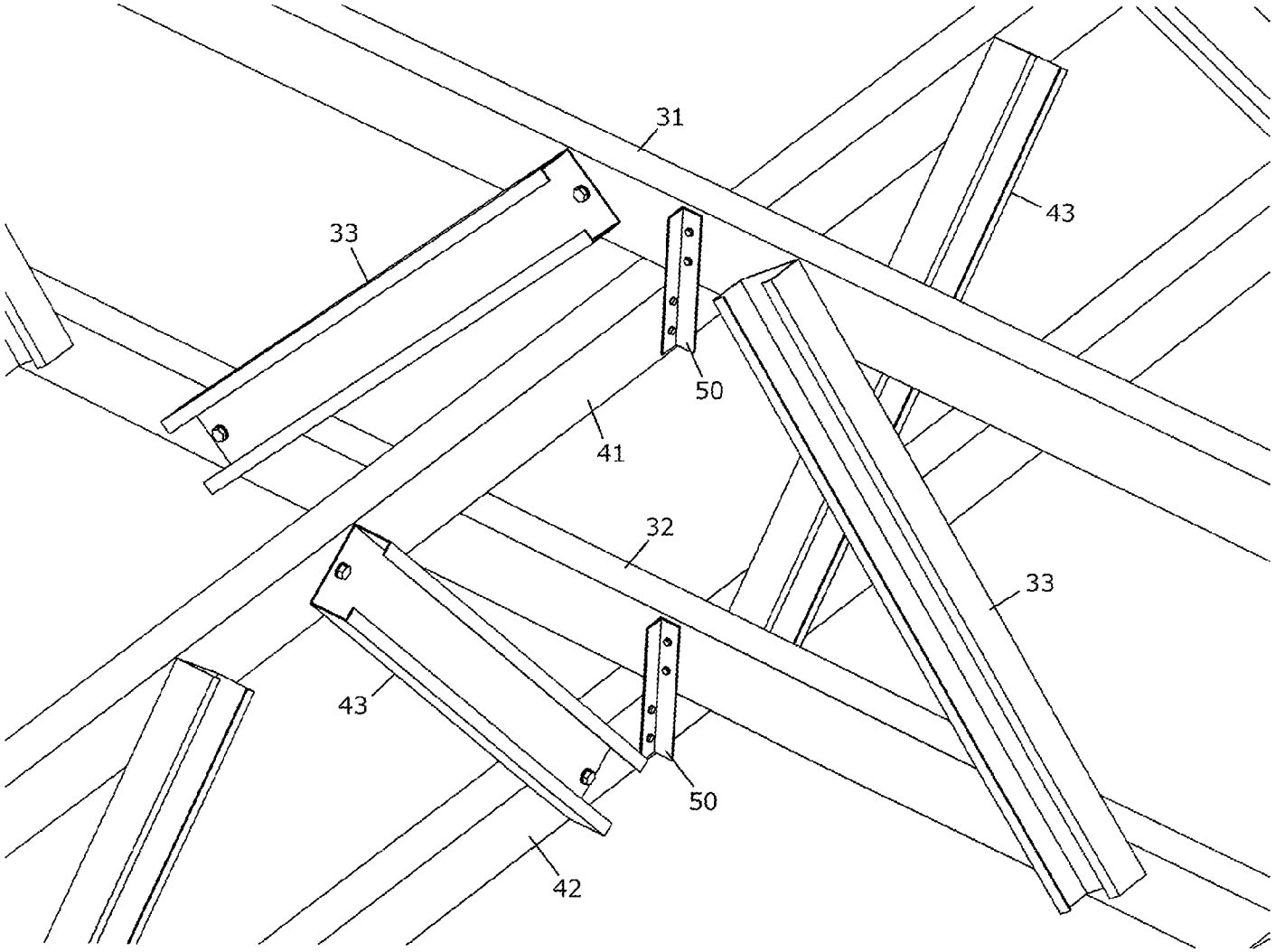
FIG. 5 is a perspective view of a section where the first beam intersects the second beam.

Referring to FIG. 2 again reveals that each unit 10 is a structure formed by latticing the first beams 30 and the second beams 40 together. As shown in FIG. 5, in a section where the first beam 30 intersects the second beam 40, the upper chord 31 of the first beam 30 is disposed on the upper chord 41 of the second beam 40. The upper chord 31 of the first beam 30 is joined to the upper chord 41 of the second beam 40 via a joining member 50, by using fasteners (e.g., bolts, self-drill screws, rivets, or the like). The joining member 50 is applicable if it has a joining surface jointed to the upper chord 31 of the first beam 30 and a joining surface jointed to the upper chord 41 of the second beam 40. An example of such a joining member 50 is an angle iron (e.g., equal-angle steel). By using the joining member 50 as an angle iron having two joining surfaces intersecting at a given angle (e.g., 90 degrees), the first beam 30 and the second beam 40 are easily caused to intersect at the given angle.

As shown in FIG. 5, in the section where the first beam 30 intersects the second beam 40, the lower chord 32 of the first beam 30 is disposed on the lower chord 42 of the second beam 40. The lower chord 32 of the first beam 30 is joined to the lower chord 42 of the second beam 40 via a joining member 50, using fasteners.

According to the present invention, the first beam 30 and the second beam 40 are joined together in the above manner. This allows each of the chords 31, 32, 41, and 42 to be provided as a single member, thus making assembling work easy and allowing assembling work to be finished in a short time. Because the first beam 30 and the second beam 40 are joined by using the fasteners, assembling precision can be improved significantly, compared to the case of welding the first beam 30 and the second beam 40 together.

The upper chord 31 of the first beam 30, which is disposed on the upper chord 41 of the second beam 40, can function as a purlin that supports a roof material. Using the upper chord 31, therefore, makes the purlin unnecessary, in which case a process of attaching the purlin can be omitted.

Figure 6:
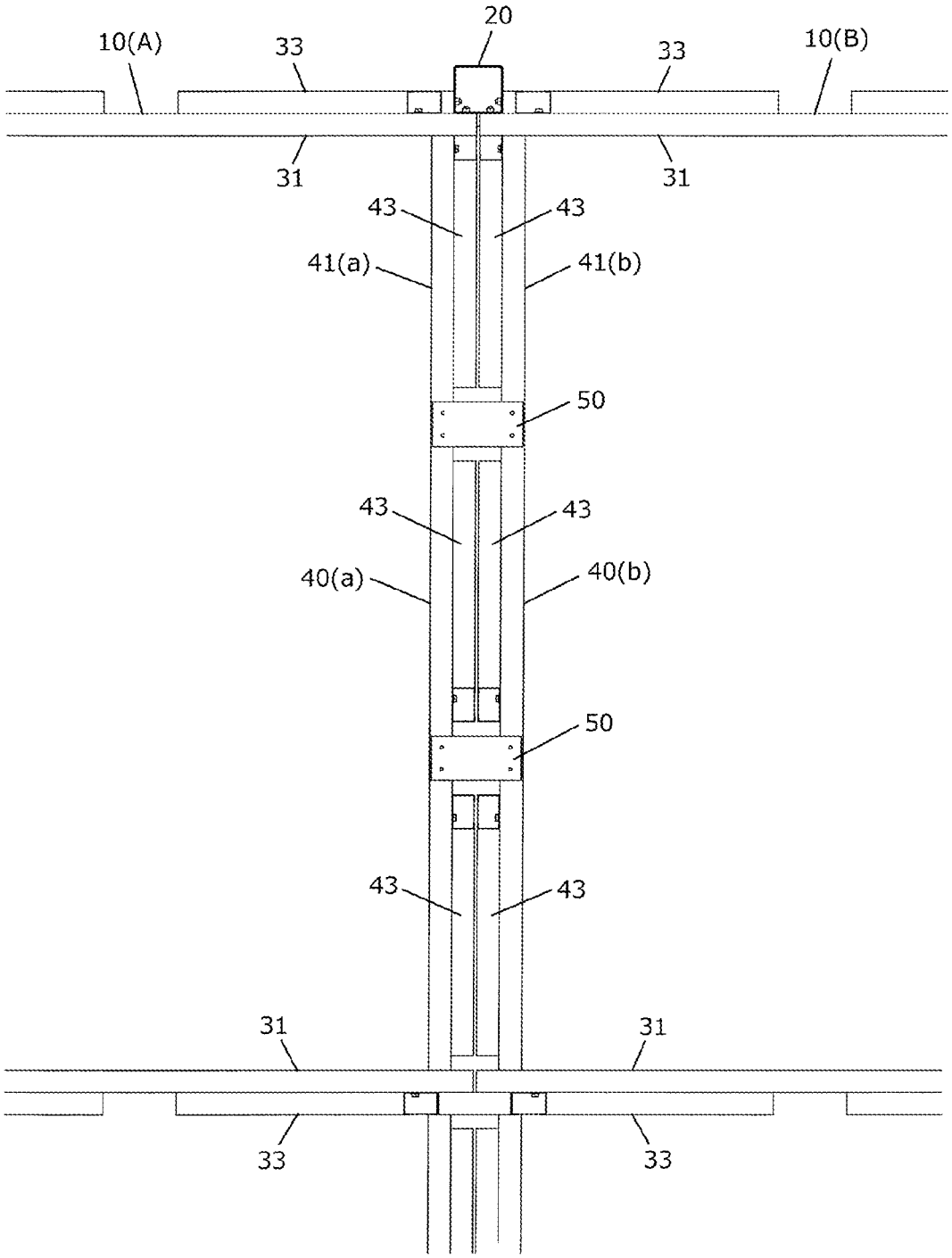
FIG. 6 is a plan view showing a state in which upper chords on respective ends of adjacent units are jointed together via joining members.

As shown in FIG. 6, upper chords 41(*a*) and 41(*b*) on respective ends of units 10(A) and 10(B) adjacent to a post 20 are joined together via joining members 50 (e.g., metal plates), by using fasteners (e.g., bolts, self-drill screws, rivets, or the like). Lower chords on respective ends of the units adjacent to the post are joined together via joining members, using fasteners, in the same manner as the upper chords 41(*a*) and 41(*b*) on respective ends are. In this configuration, the rigidity of girders (i.e., second beams 40(*a*) and 40(*b*) jointed to the post 20) increases, and therefore buckling of the girders can be inhibited effectively.

The building structure according to this embodiment can be applied to various buildings for different uses, such as houses, retail shops including convenience stores, restaurants, factories, and warehouses.

A preferred building method for a building having the building structure according to this embodiment includes (1) a process of forming the unit (10) on a foundation 60 on which posts 20 are already set in place, and (2) a process of lifting up the unit 10, using the posts 20 as a guide.

Figure 7:
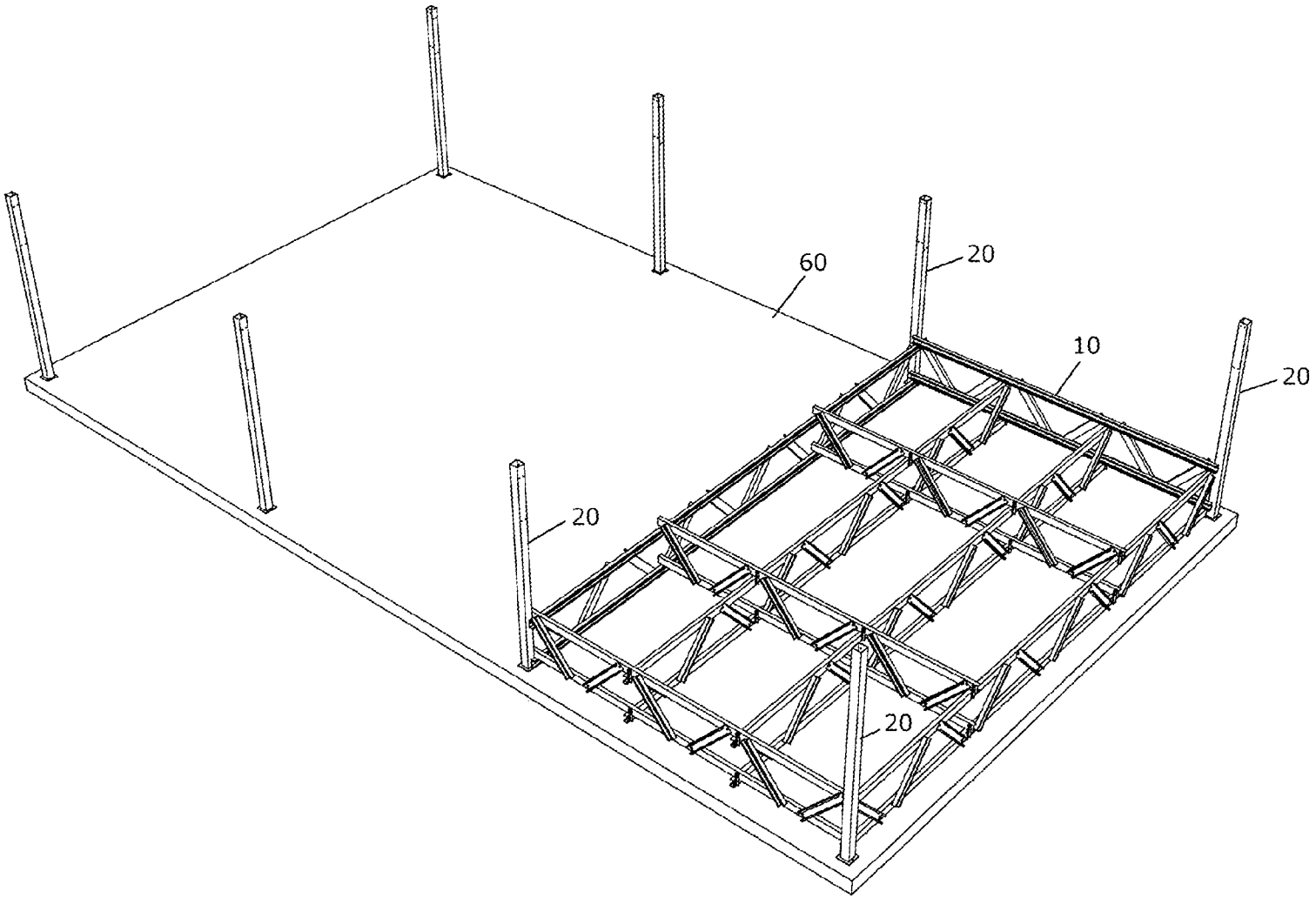
FIG. 7 is a perspective view for explaining a building method.

At the process (1), as shown in FIG. 7, the unit 10 is assembled on the foundation 60 on which the posts 20 are already erected. Securing a place for assembling the unit 10 around the foundation 60 is, therefore, unnecessary. To construct a typical building, a plurality of the units 10 are used. In this case, assembling each unit 10 on the foundation 60 on which the posts 20 are already erected means an advantage that the building can be constructed even in a building site with a small area.

Figure 8:
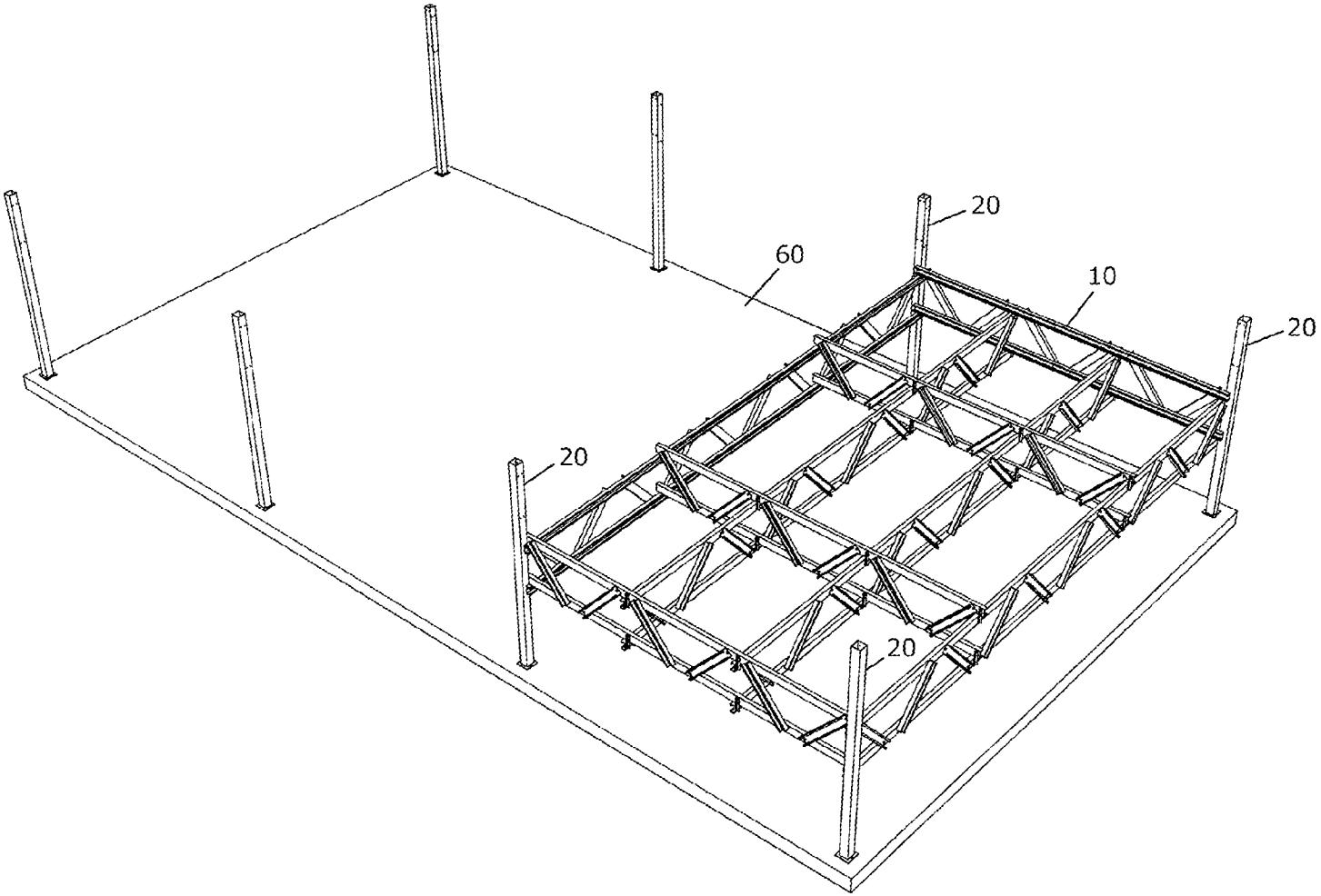
FIG. 8 is a perspective view for explaining the building method.

At the process (2), to join the unit 10 to the posts 20, the unit 10 is lifted up to a place with a given height from the ground, using a crane, lifter, or the like. In this process, as indicated in FIG. 8, the posts 20 in contact with the unit 10 can be used as a guide. This allows the ascending unit 10 to be kept in a stable state. A collision of the unit 10 with another unit already set in place, therefore, can be prevented effectively.

Figure 9:
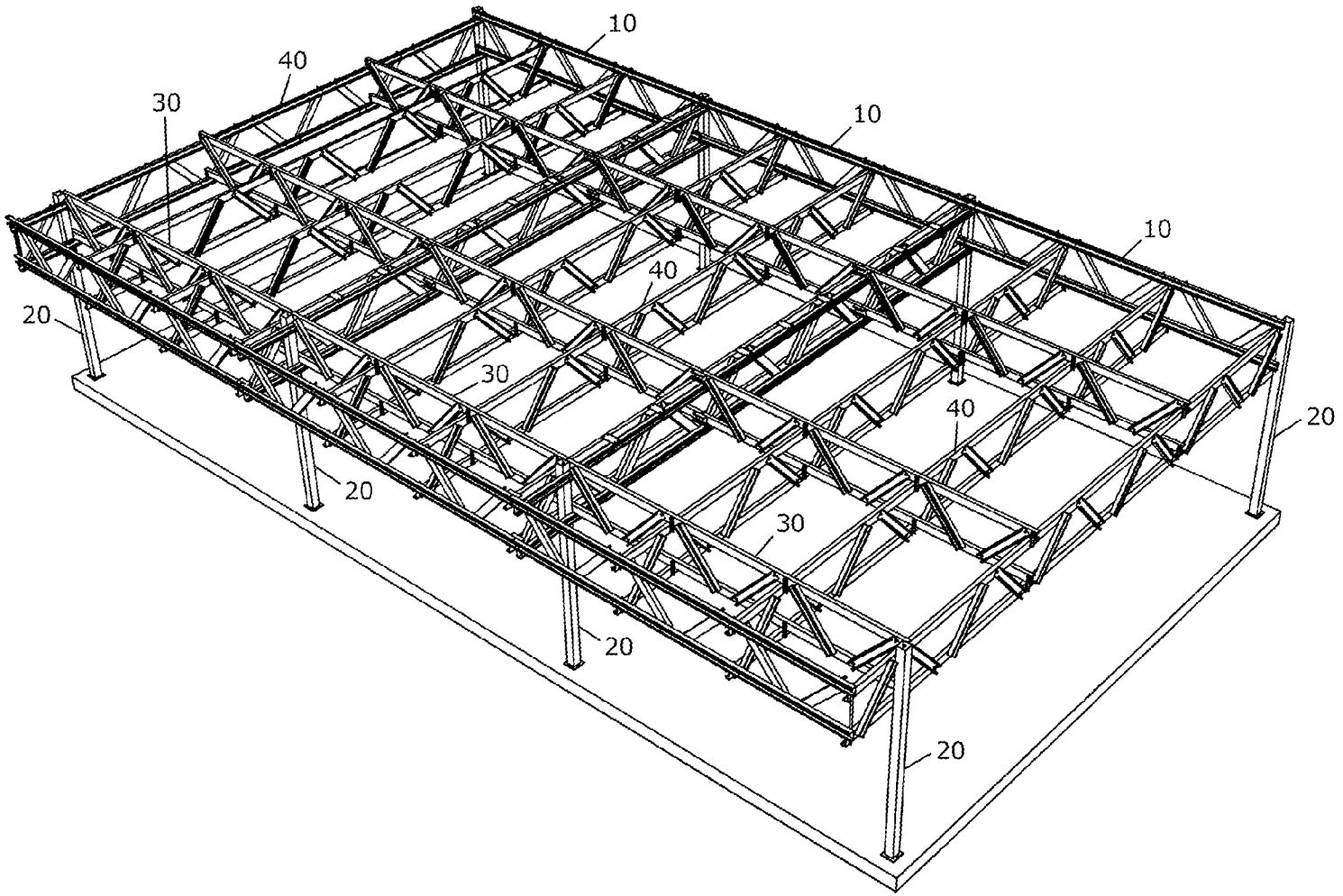
FIG. 9 is a perspective view of a building structure according to another embodiment of the present invention.
Figure 10:
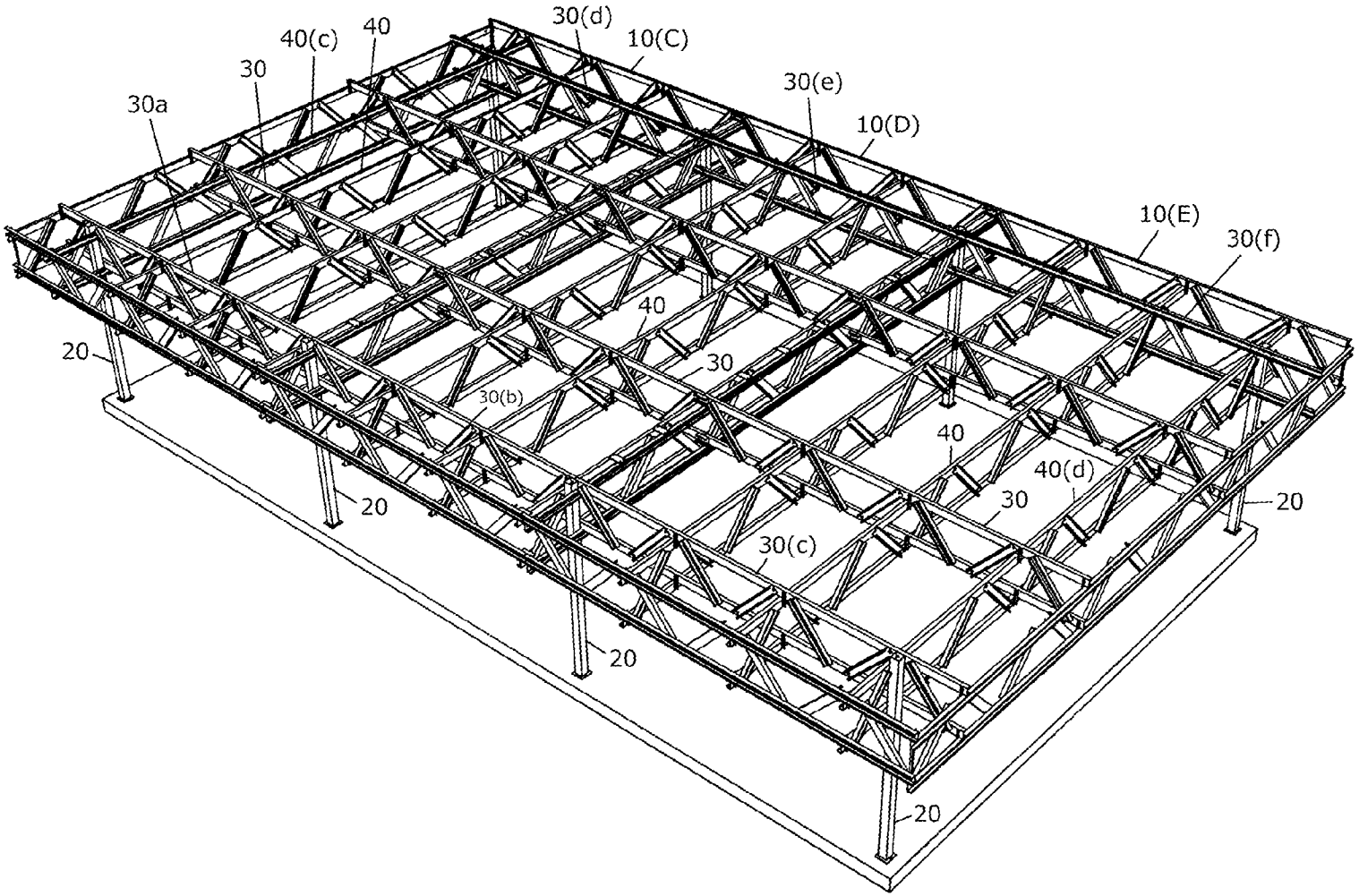
FIG. 10 is a perspective view of a building structure according to still another embodiment of the present invention.
Figure 11:
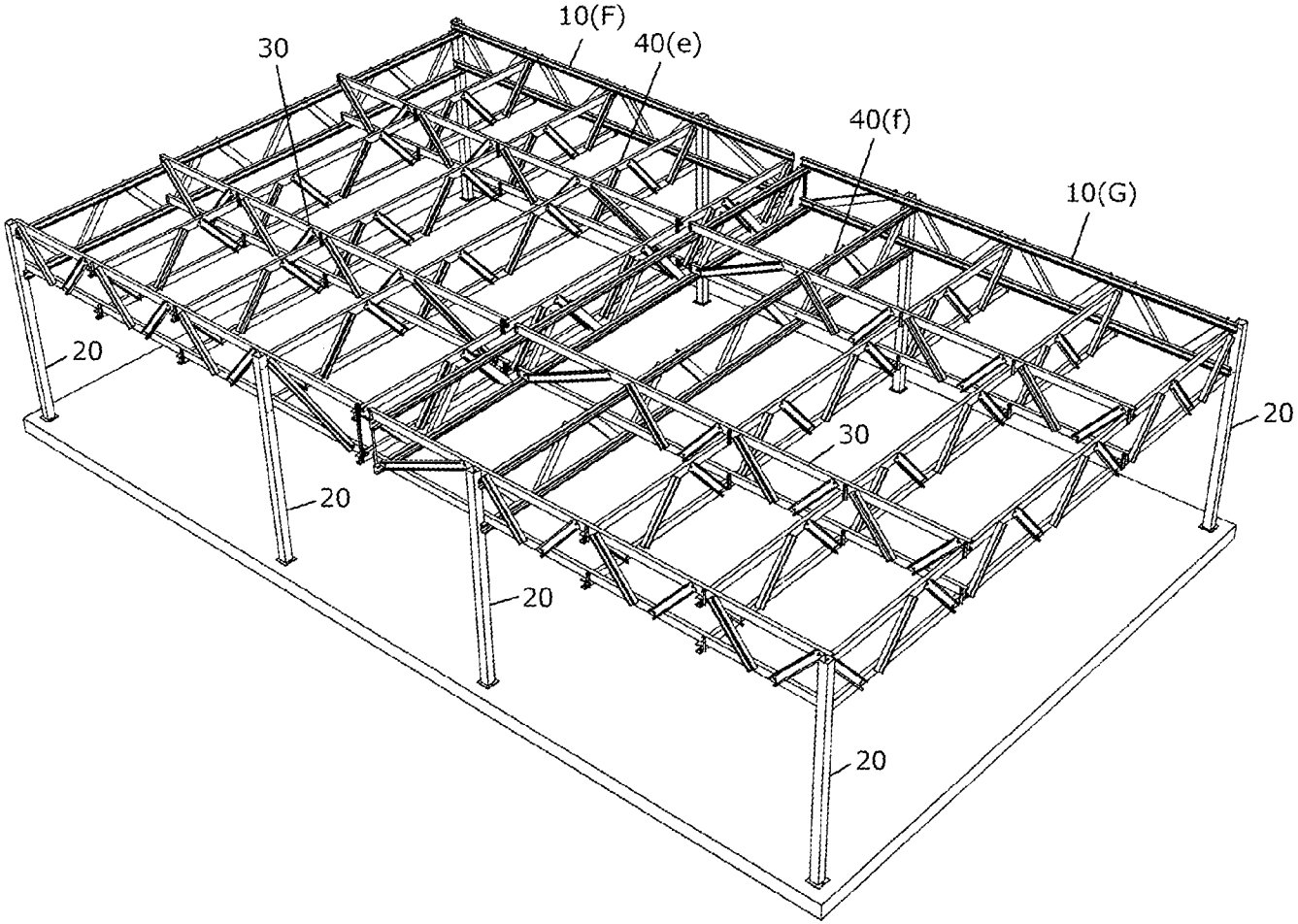
FIG. 11 is a perspective view of a building structure according to still another embodiment of the present invention.

The first beam 30 and/or the second beam 40 may have an elongated portion overhanging from a girder (i.e., beam jointed to posts). In another embodiment of the present invention, the second beams 40 of each unit 10 each have an elongated portion overhanging from a girder (i.e., the first beam 30 jointed to posts 20), as shown in FIG. 9. The elongated portion overhanging from the girder has high strength against a vertical load, and therefore needs not be supported by the post. In still another embodiment of the present invention, the first beams 30 of units 10(C) and 10(E) located on both sides each have elongated portions overhanging from girders (i.e., second beams 40(*c*) and 40(*d*) jointed to posts 20), and the second beams 40 of the same each have elongated portions overhanging from girders (i.e., first beams 30(*a*), 30(*c*) and 30(*d*), 30(*f*) that are jointed to posts 20), as shown in FIG. 10. The second beams 40 of a unit 10(D) located at the center each have elongated portions overhanging from girders (i.e., first beams 30(*b*) and 30(*e*) jointed to posts 20). In still another embodiment of the present invention, the first beams 30 of a unit 10(F) each have an elongated portion overhanging from a girder (i.e., second beam 40(*e*) jointed to posts 20) while the first beams 30 of a unit 10(G) each have an elongated portion overhanging from another girder (i.e., second beam 40(*f*) jointed to posts 20), as shown in FIG. 11. In a building structure shown in FIG. 11, as a result of the first beams having the elongated portions overhanging from both girders, the number of units is reduced. Consequently, this building structure has fewer units than the building structure shown in FIG. 1.

REFERENCE SIGNS LIST

10 unit
20 post
30 first beam
31 upper chord
32 lower chord
33 diagonal bracing
40 second beam
41 upper chord
42 lower chord
43 diagonal bracing
50 joining member
60 foundation

The invention claimed is:

1. A building structure for transmitting a load on a roof to a post, the building structure comprising:

a unit joined to a post, the unit including three or more first beams arranged in parallel in one direction and three or more second beams arranged in parallel in another direction intersecting the one direction, wherein each of the first beams and of the second beams has a truss structure, and wherein in a section where the first beam intersects the second beam, an upper chord of the first beam is disposed on an upper chord of the second beam and is joined to the upper chord of the second beam via a joining member, using a fastener, and a lower chord of the first beam is disposed on a lower chord of the second beam and is joined to the lower chord of the second beam via a joining member, using a fastener.

2. The building structure according to claim 1, wherein an upper chord, a lower chord, and a diagonal bracing that make up the truss structure are made of light shaped steels having the same sectional dimension.

3. The building structure according to claim 1, wherein a first beam and/or a second beam has an elongated portion overhanging from a girder.

4. The building structure according to claim 1, comprising a plurality of units, wherein upper chords on respective ends of units adjacent to a post are jointed together via a joining member, using a fastener, while lower chords on respective ends of the units adjacent to the post are jointed together via a joining member, using a fastener.

5. A building having the building structure according to claim 1.

6. A building method for a building having a building structure for transmitting a load on a roof to a post, the building method comprising:

a process of forming a unit on a foundation on which posts are already set in place, the unit being structured such that the unit includes three or more first beams arranged in parallel in one direction and three or more second beams arranged in parallel in another direction intersecting the one direction, that each of the first beams and of the second beams has a truss structure, and that in a section where the first beam intersects the second beam, an upper chord of the first beam is disposed on an upper chord of the second beam and is joined to the upper chord of the second beam via a joining member, using a fastener, and a lower chord of the first beam is disposed on a lower chord of the second beam and is joined to the lower chord of the second beam via a joining member, using a fastener; and a process of lifting up the unit while using the posts as a guide.

* * * * *